US006022016A

United States Patent [19]

Cheong

[11] Patent Number: 6,022,016

[45] Date of Patent: Feb. 8, 2000

[54] PAPER CASSETTE FOR AN ELECTROPHOTOGRAPHIC APPARATUS

[75] Inventor: Sang-Won Cheong, Seoul, Rep. of Korea

[73] Assignee: SamSung Electronics Co., Ltd., Kyungki-do, Rep. of Korea

[21] Appl. No.: 09/185,735

[22] Filed: Nov. 4, 1998

[30] Foreign Application Priority Data

Nov. 4, 1997 [KR] Rep. of Korea ..... 97-57857

[51] Int. Cl.[7] ..... B65H 3/54

[52] U.S. Cl. ..... 271/170

[58] Field of Search ..... 271/170, 169, 271/167, 162, 160

[56] References Cited

U.S. PATENT DOCUMENTS 4,828,245 5/1989 Shimogawara ..... 271/170 X 5,443,251 8/1995 Kan et al. ..... 271/170 X

*Primary Examiner*—David H. Bollinger

*Attorney, Agent, or Firm*—Robert E. Bushnell, Esq.

[57] ABSTRACT

A paper cassette having an improved finger may be provided. The finger may be constructed using a flange for pressing down on sheets of paper that are loaded on the upper part of a tray. The flange has a pair of shaft connectors each bearing a bore that can accommodate a shaft. A plate can be pivotally attached to the flange via said shaft. A second pair of shaft connectors are attached to the plate for engaging the shaft. A spring may be used to bias the plate against any papers stacked on the tray to restrain the papers from premature loading into the electrophotographic apparatus. In addition restraining rings may be used to prevent the shaft form disengaging either of the pair of shaft connectors.

18 Claims, 6 Drawing Sheets

PAPER CASSETTE FOR AN ELECTROPHOTOGRAPHIC APPARATUS

CLAIM OF PRIORITY

This application makes reference to, incorporates the same herein, and claims all benefits accruing under 35 U.S.C. § 119 from my application entitled Auto Sheet Feed Device of Office Automation Systems filed with the Korean Industrial Property Office on Nov. 4, 1997 and there duly assigned Serial No. 97-57857 by that Office.

BACKGROUND OF THE INVENTION

1. Field of the Invention

The present invention relates to a paper cassette for an electrophotographic apparatus and, more specifically, to a paper cassette having an improved fingering device.

2. Background Art

An image formation apparatus (e.g., a printer, scanner, facsimile or copier) must often accommodate printable mediums having a thickness or dimensions different from that of standard paper. Envelopes, postcards, transparencies, labels and resume paper are just a few examples of the different printable mediums that a sheet feeder must accommodate. A sheet feeder may be constructed to use a tray that supplies paper to a printer. The tray often has an adjustment lever allowing the paper to be moved away from a pickup roller in order to load additional sheets of paper into the tray. After loading additional paper, the adjustment lever is moved in a direction opposite that used for preparing the tray to receive additional paper causing the pickup roller to press against the paper on the tray and then transfer the paper to a transfer roller. Then, the transfer roller transports the sheet of paper to the printer cartridge.

However, when an envelope or a postcard weighing more than 90 g is attempted to be fed into the printer, the pick up roller is often unable to overcome the frictional force exerted by the finger of the paper cassette. This leads to paper jams that can disrupt an efficiently running business.

To overcome this problem some conventional printers require the manual feeding of thick paper into the printer. This results in the consumption of human resources and lowers the printer's efficiency. Another method has been to use a mode conversion lever that could be adjusted to prevent the finger from being operated. Thus, when a user wanted to print on heavy paper, the mode of the paper cassette could be set to prevent the finger from restraining the loading of paper into the printer.

I believe that is may be possible to improve on the contemporary art by providing a paper cassette that has a finger that allows paper to pass by simply pushing against a side plate and that does not require special handling by a user to accommodate thicker and heavier sheets of paper or envelopes.

SUMMARY OF THE INVENTION

Accordingly, it is an object of the present invention to provide a paper cassette with an improved finger device.

It is another object to provide a paper cassette with a finger that allows paper to be fed when the paper is pushed with enough force to rotate a plate that is pivotally connected to a flange of the finger.

It is still another object to provide a paper cassette with a finger that does not require special handling by a user to accommodate thicker and heavier sheets of paper or envelopes.

To achieve these and other objects, a paper cassette having an improved finger may be provided. The finger may be constructed using a flange for pressing down on sheets of paper that are loaded on the upper part of a tray. The flange has a pair of shaft connectors each bearing a bore that can accommodate a shaft. A plate can be pivotally attached to the flange via said shaft. A second pair of shaft connectors are attached to the plate for engaging the shaft. A spring may be used to bias the plate against any papers stacked on the tray to restrain the papers from premature loading into the electrophotographic apparatus. In addition restraining rings may be used to prevent the shaft form disengaging either of the pair of shaft connectors.

BRIEF DESCRIPTION OF THE DRAWINGS

A more complete appreciation of the invention, and many of the attendant advantages thereof, will be readily apparent as the same becomes better understood by reference to the following detailed description when considered in conjunction with the accompanying drawings in which like reference symbols represent the same or similar components, wherein.

DETAILED DESCRIPTION OF THE DRAWINGS

Figure 1:
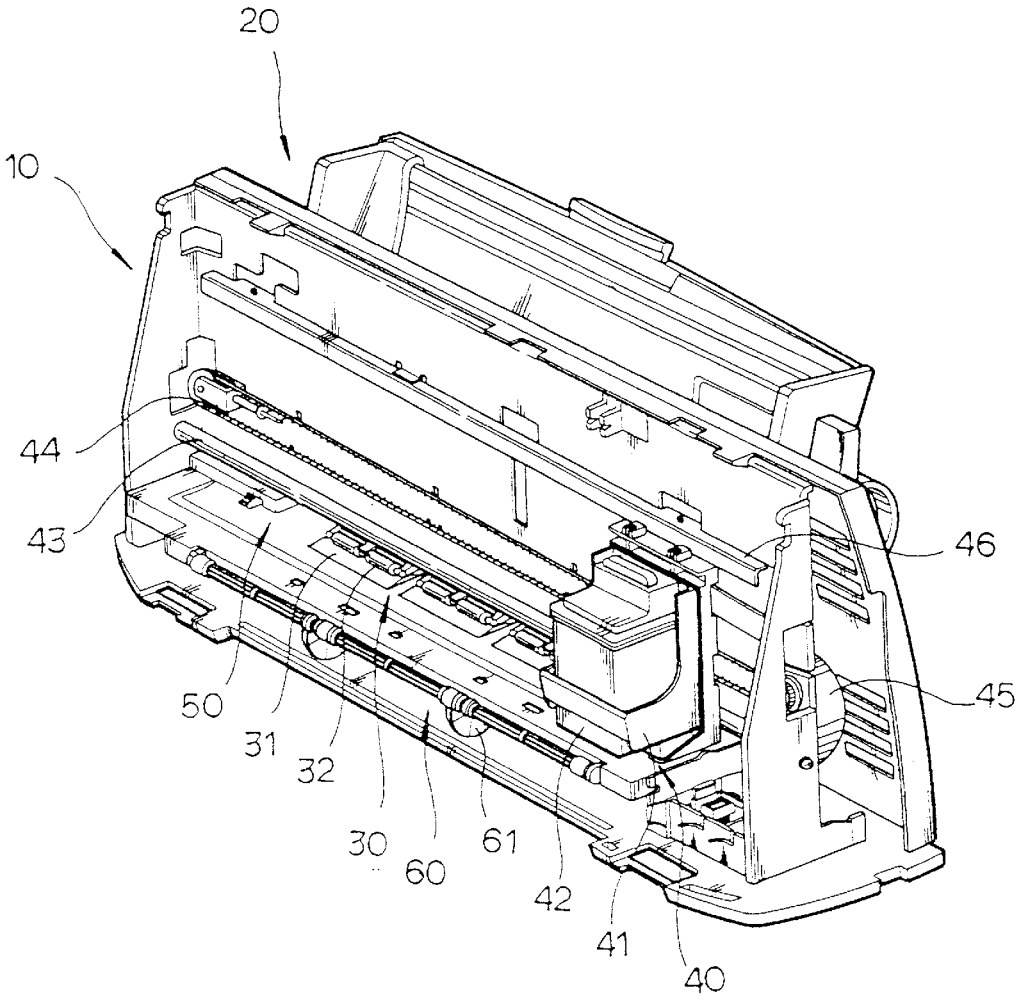
FIG. 1 is a perspective view of an ink jet printer.
Figure 2:
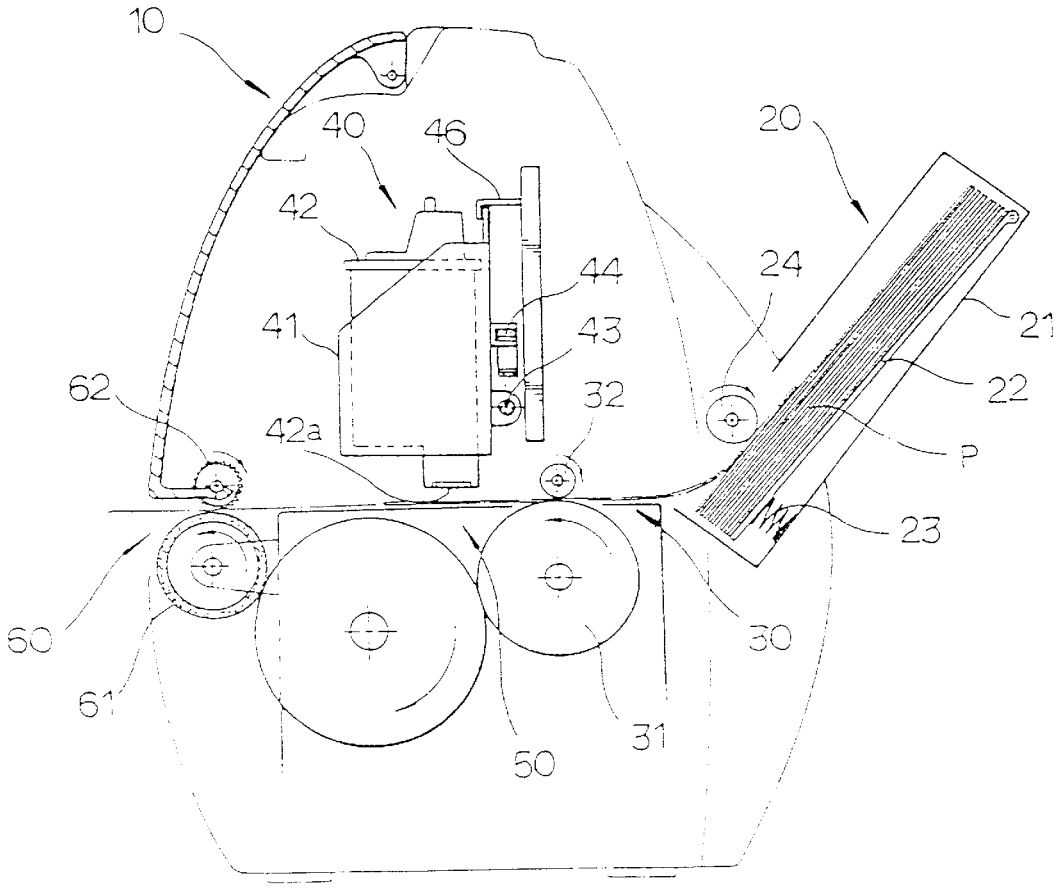
FIG. 2 is a side view of the printer of FIG. 1.

Turning now to the drawings, FIG. 1 illustrates a perspective front view a printer. FIG. 2 shows a printer preparing to load a sheet of paper. Papers are loaded in tray 22 of frame of sheet feeding device 20. As the amount of paper is increased, elastic member 23 is compressed. Tray 22 is pushed by pick-up cam 25 that is formed using semicircular roller 24 that rotates to feed paper into , then the tray 22 with the paper gets to go up by the elastic member 23, and so to adhere closely to a cylindrical surface of the pick up roller 24. Pick-up roller 24 loads the paper stacked in tray 22 and transports the paper path 30.

The paper transported through paper path 30 is transported to printing device 40 by the rotating pressure of feed roller 31 and friction roller 32. Then, a carriage driving motor (not shown) drives belt 44 in a reciprocal fashion. Carriage 41 is fixed to guide rail 46 and slides along the guide rail in a reciprocating fashion along carriage shaft 45. Printing is performed on the paper that is transported along paper transport path 30 past nozzles 42*a* that are attached to head cartridge 42.

Subsequently, the head cartridge completes the printing of images as the paper slowly moves by nozzle 42*a*. The paper is then transported to paper discharger part 60, and the paper is discharged after passing between discharge roller 51 and star wheel 62.

Figure 3:
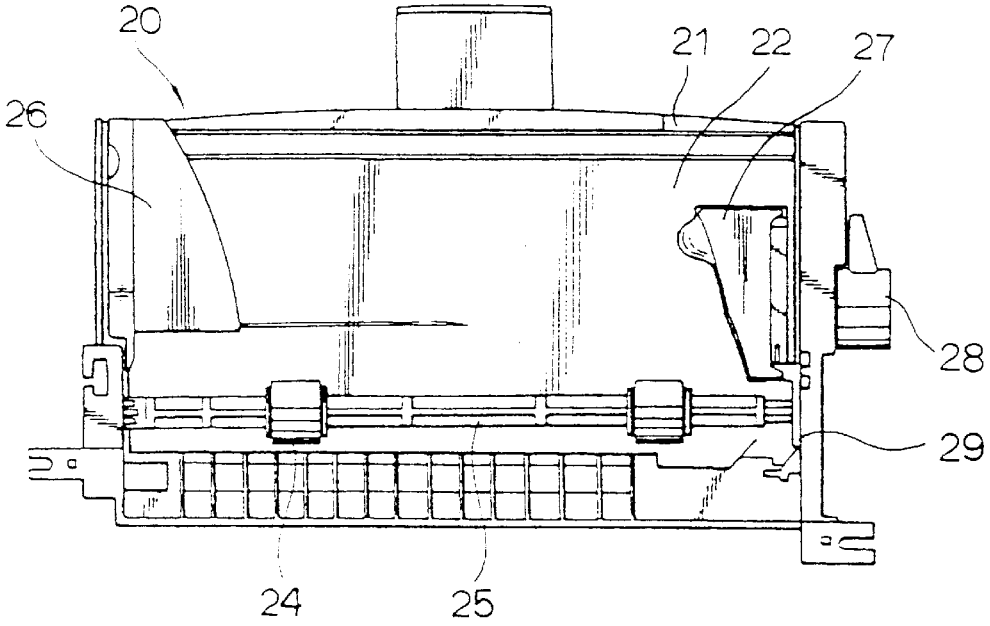
FIG. 3 is a plan view of a paper cassette.

A paper cassette is shown in FIG. 3 that has mode conversion lever 28 attached to one side of the cassette. Left guide 26 may be adjusted laterally to accommodate various sizes of paper that can be inserted into the paper cassette. Right guide 27 is fixed to the right part of tray 22 and finger 29 is attached to the right part of tray 22. When a sheet is loaded onto the paper cassette, the sheet is picked up by the rotation of pick up roller 24 that is attached to pick up shaft 25.

Figure 4:
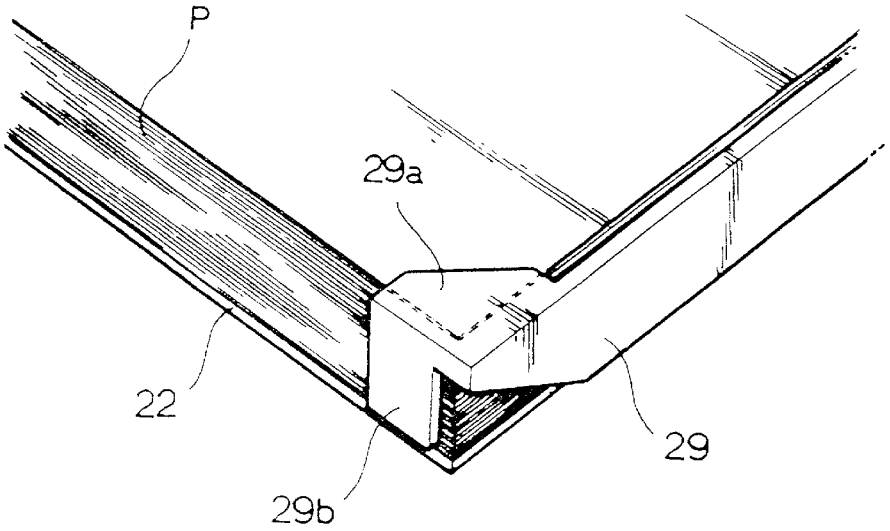
FIG. 4 illustrates a finger device.

A finger that may be used with a paper cassette is shown in FIG. 4. The finger only allows paper to be fed when the pick up roller provides enough force to overcome the friction between the finger and the sheet of paper. The finger works well enough with paper weighing around 60 g~90 g, such as A4 sized paper. As shown, finger 29 has a first portion 29*a* and a second portion 29*b*, both of which are integrally formed with finger 29 and restrict the movement of paper 'P' that is loaded on tray 22.

Figure 5:
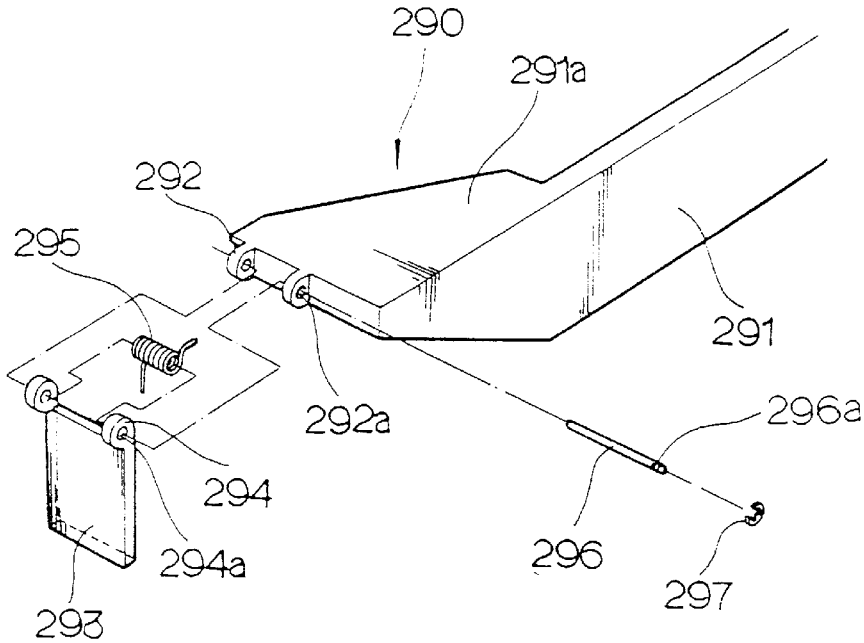
FIG. 5 is an exploded perspective view of a finger device as constructed according to the principles of the present invention.
Figure 6:
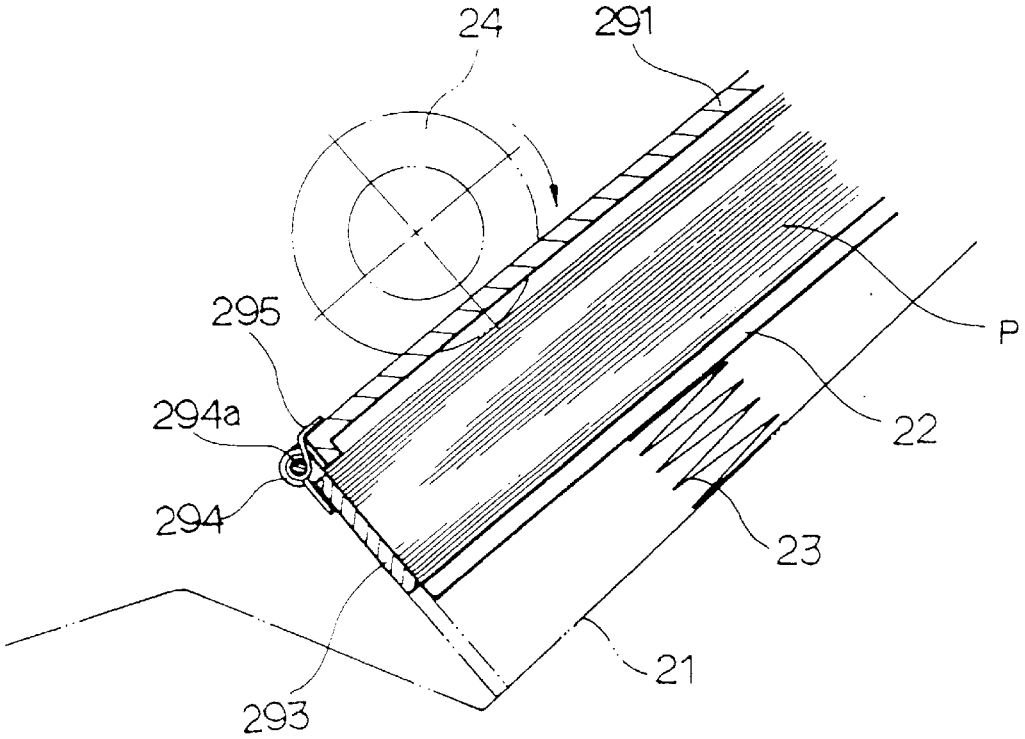
FIG. 6 is a side view of the finger of FIG. 5 when paper is not being fed into the electrophotographic device.
Figure 7:
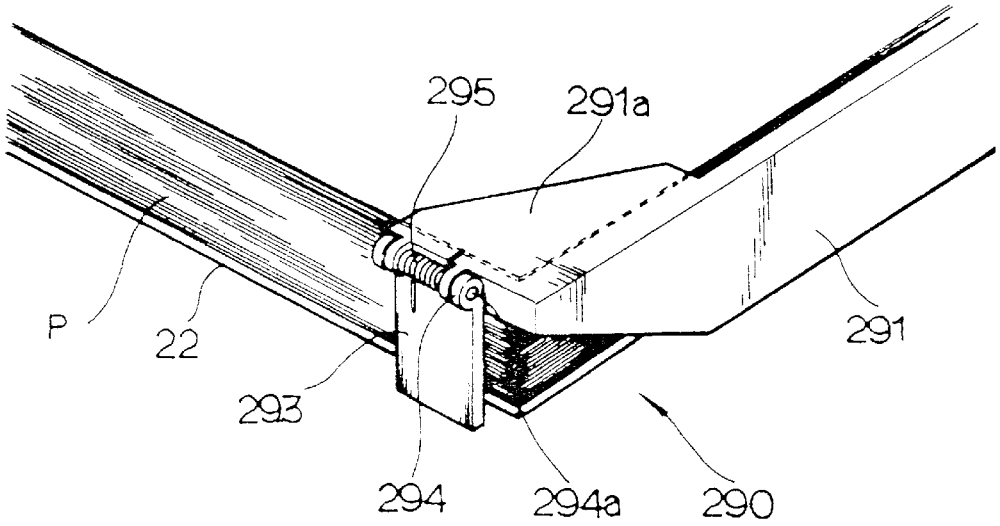
FIG. 7 is a perspective view of the finger of FIG. 5 when paper is not being fed into the electrophotographic device.
Figure 8:
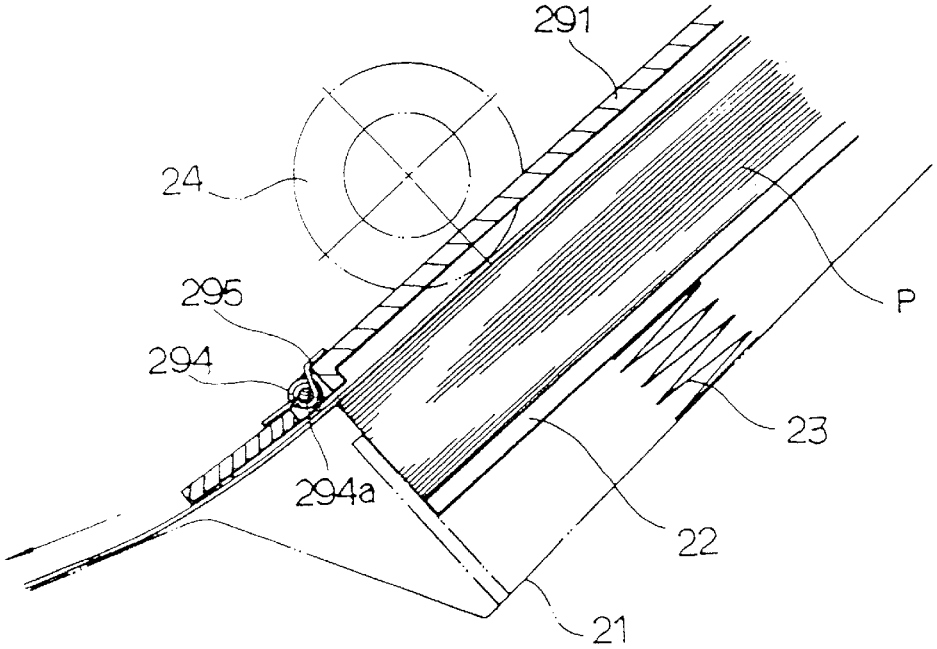
FIG. 8 is a side view of the finger of FIG. 5 when paper is being fed into the electrophotographic device.
Figure 9:
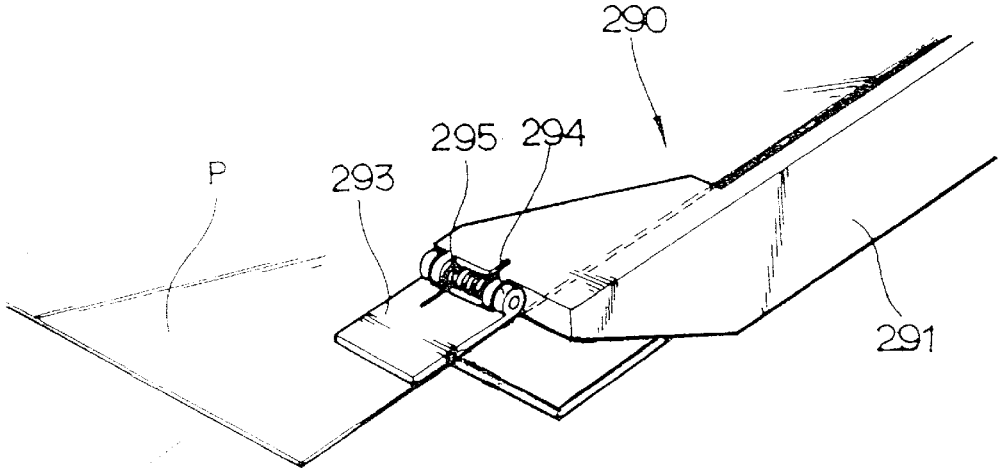
FIG. 9 is a perspective view of the finger of FIG. 5 when paper is being fed into the electrophotographic device.

FIG. 5 illustrates a finger as constructed according to the principles of the present invention. present invention. FIGS. 6 and 7 show the finger of FIG. 5 when paper is not being fed into the electrophotographic device. FIGS. 8 and 9 show the finger of FIG. 5 when paper is being fed into the electrophotographic device. Finger 291 may be constructed with flange 291*a* that applies a force on the sheets of paper stacked on the tray towards the base of the frame of the paper cassette. Plate 293 is pivotally connected to flange 291*a* to allow paper to be fed into the electrophotographic apparatus by moving plate 293 out of the way. First pair of shaft connector 292 project from flange 291*a* and having bores 292*a* that can be used to secure shaft 296. Plate 293 has second pair of shaft connectors 294 projecting from plate 293. Each of second pair of shaft connectors 294 has bore 294*a* to rotatably engage shaft 296.

Spring 295 provides force to bias plate 293 against the stack of paper. Spring 295 may be a torsion spring that is positioned over shaft 296. Shaft 296 has a circumferential groove 296*a* that receivably engages retaining ring 297 to prevent the removal or slipping of retaining ring 297.

To assemble the finger a user aligns the connectors projecting from the plate with those of first shaft connector 292. Then, spring 295 is inserted over the path formed by the aligned bores of the first and second pairs of shaft connectors. Then, shaft 296 is inserted through both the springs and the bores in the shaft connectors to pivotally connect plate 293 to flange 291*a*. After the shaft is inserted between the two pairs of shaft connectors, retaining ring 297 is inserted into circumferential groove 296*a* to secure the shaft. A circumferential groove and retaining ring may be positioned proximate to both ends of the shaft. Retaining ring 297 may be an E-ring, a C-ring or another suitable retaining ring. The E-ring and the C-ring prevent the shaft from sliding out from the first and second pair of connectors.

To operate the paper cassette using the inventive finger, a user loads paper onto tray 22 of paper cassette 20 to feed to an image forming device. The sheets of paper are positioned up against the side of the frame that supports the finger. The corner of the sheet is restrained by finger 291 and flange 291*a*. When a sheet of paper weighing 60 g~90 g, such as A4 size paper, plate 293 is biased against the direction of feeding of the sheet of paper by spring 295.

When the pick up roller loads paper into the image forming device, a sheet is pushed against plate 293 until the plate rotates and allows the top sheet to be loaded. Furthermore, when sheets of paper, or other material, weighing more than 90 g, such as an envelope or a postcard, are used, the sheet pushes plate 293. The sheet of paper is given force form the rotation of pick up roller 24.

As explained above, the present invention is able to efficiently feed various thicknesses and weights of materials into the image forming device without causing a paper jam. Although this preferred embodiment of the present invention has been disclosed for illustrative purposes, those skilled in the art will appreciate that various modifications, additions and substitutions are possible, without departing from the scope and spirit of the invention as disclosed in the accompanying claims. It is also possible that other benefits or uses of the currently disclosed invention will become apparent over time.

What is claimed is:

1. A paper cassette for an electrophotographic apparatus, comprising:

a frame having a base;

a tray pivotally mounted to said base in said frame, said tray supporting a plurality of cut sheets for feeding into said electrophotographic apparatus;

an elastic member mounted between said base of said frame and said tray biasing said tray away from said frame;

a finger pivotally attached to said frame and restraining said sheets from being fed into said electrophotographic apparatus, said finger comprising:

a flange overlapping a corner of said cut sheets;

a plate pivotally attached to said flange and covering a portion of a side of a stack of said cut sheets to deter said cut sheets from being loaded into said electrophotographic apparatus; and a spring biasing said plate against said stack of cut sheets; and said plate rotating to allow one of said cut sheets to be loaded into said electrophotographic apparatus when said one of said cut sheets is pressed against said plate with a sufficient force to overcome a biasing force of said spring.

2. The paper cassette of claim 1, further comprised of:

a first pair of connectors projecting from said flange and each bearing a bore;

a second pair of connectors projecting from said plate and each bearing a bore; and a shaft inserted through said bore in each of said first pair of connectors and through said bore in each of said second pair of connectors to pivotally connect said plate to said flange.

3. The paper cassette of claim 2, further comprised of said shaft having a circumferential groove disposed near an end.

4. The paper cassette of claim 3, further comprising a retaining ring engageable with said circumferential groove in said shaft.

5. The paper cassette of claim 4, further comprised by said spring being a torsional spring enclosing said shaft.

6. The paper cassette of claim 4, with said retaining ring being comprised of any one of an E-ring and a C-ring.

7. The paper cassette of claim 6, further comprised of a torque provided by said spring being lower than said sufficient force generated by said electrophotographic apparatus during the feeding of one of said cut sheets.

8. A paper cassette for an electrophotographic apparatus, comprising:

a frame having a base;

a tray pivotally mounted to said base in said frame, said tray supporting a plurality of cut sheets for feeding into said electrophotographic apparatus;

an elastic member mounted between said base of said frame and said tray biasing said tray away from said frame;

a finger pivotally attached to said frame and restraining said sheets from being fed into said electrophotographic apparatus, said finger comprising:

a flange overlapping a corner of said cut sheets, said flange having a first pair of connectors projecting from said flange each bearing a bore;

a plate pivotally attached to said flange and covering a portion of a side of a stack of said cut sheets to deter said cut sheets from being loaded into said electrophotographic apparatus, said plate having a second pair of connectors projecting from said plate and each bearing a bore;

a shaft inserted through said bore in each of said first pair of connectors and through said bore in each of said second pair of connectors to pivotally connect said plate to said flange; and a spring biasing said plate against said stack of cut sheets; and said plate rotating to allow one of said cut sheets to be loaded into said electrophotographic apparatus when said one of said cut sheets is pressed against said plate with a sufficient force to overcome a biasing force of said spring.

9. The paper cassette of claim 8, further comprised of said shaft having a circumferential groove disposed near an end.

10. The paper cassette of claim 9, further comprising a retaining ring engageable with said circumferential groove in said shaft.

11. The paper cassette of claim 10, further comprised by said spring being a torsional spring enclosing said shaft.

12. The paper cassette of claim 10, with said retaining ring being comprised of any one of an E-ring and a C-ring.

13. The paper cassette of claim 12, further comprised of a torque provided by said spring being lower than said sufficient force generated by said electrophotographic apparatus during the feeding of one of said cut sheets.

14. A paper cassette for an electrophotographic apparatus, comprising:

a frame having a base;

a tray pivotally mounted to said base in said frame, said tray supporting a plurality of cut sheets for feeding into said electrophotographic apparatus;

an elastic member mounted between said base of said frame and said tray biasing said tray away from said frame;

a finger pivotally attached to said frame and restraining said sheets from being fed into said electrophotographic apparatus, said finger comprising:

a flange overlapping a corner of said cut sheets, said flange having a first pair of connectors projecting from said flange each bearing a bore;

a plate pivotally attached to said flange and covering a portion of a side of a stack of said cut sheets to deter said cut sheets from being loaded into said electrophotographic apparatus, said plate having a second pair of connectors projecting from said plate and each bearing a bore;

a shaft inserted through said bore in each of said first pair of connectors and through said bore in each of said second pair of connectors to pivotally connect said plate to said flange; and a torsional spring enclosing said shaft and biasing said plate against said stack of cut sheets; and said plate rotating to allow one of said cut sheets to be loaded into said electrophotographic apparatus when said one of said cut sheets is pressed against said plate with a sufficient force to overcome a biasing force of said spring.

15. The paper cassette of claim 14, further comprised of said shaft having a circumferential groove disposed near an end.

16. The paper cassette of claim 15, further comprising a retaining ring engageable with said circumferential groove in said shaft.

17. The paper cassette of claim 16, with said retaining ring being comprised of any one of an E-ring and a C-ring.

18. The paper cassette of claim 17, further comprised of a torque provided by said spring being lower than said sufficient force generated by said electrophotographic apparatus during the feeding of one of said cut sheets.

* * * * *